US009393976B2

(12) United States Patent
Ikejima et al.

(10) Patent No.: US 9,393,976 B2
(45) Date of Patent: Jul. 19, 2016

(54) TRAIN GUIDANCE-DISPLAY SYSTEM AND TRAIN GUIDANCE-DISPLAY METHOD

(75) Inventors: Tomoaki Ikejima, Tokyo (JP); Takuya Sawa, Tokyo (JP); Toshiko Kadono, Tokyo (JP); Tetsuo Komura, Tokyo (JP); Shogo Tatsumi, Tokyo (JP); Shingo Honda, Tokyo (JP); Takashi Miyauchi, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 17 days.

(21) Appl. No.: 14/371,445

(22) PCT Filed: Jan. 11, 2012

(86) PCT No.: PCT/JP2012/050393

§ 371 (c)(1),
(2), (4) Date: Jul. 10, 2014

(87) PCT Pub. No.: WO2013/105232

PCT Pub. Date: Jul. 18, 2013

(65) Prior Publication Data

US 2014/0358337 A1 Dec. 4, 2014

(51) Int. Cl.
*G05D 1/00* (2006.01)
*G05D 3/00* (2006.01)
(Continued)

(52) U.S. Cl.
CPC ..... *B61L 15/0072* (2013.01); *B61L 15/009* (2013.01); *B61L 15/0036* (2013.01);
(Continued)

(58) Field of Classification Search
CPC ..... B61L 15/0072
USPC ..... 701/19; 386/230; 340/539, 539.11; 246/108
See application file for complete search history.

(56) References Cited

U.S. PATENT DOCUMENTS

2009/0261969 A1* 10/2009 Kobayashi ..... B60R 25/102 340/539.11
2011/0235989 A1* 9/2011 Morimono ..... B61L 15/0036 386/230
2012/0001029 A1* 1/2012 Kondo ..... B61L 15/0027 246/108

FOREIGN PATENT DOCUMENTS

JP 7-329785 A 12/1995
JP 10-324244 A 12/1998
(Continued)

OTHER PUBLICATIONS

International Search Report (PCT/ISA/210) mailed on Apr. 17, 2012, by the Japanese Patent Office as the International Searching Authority for International Application No. PCT/JP2012/050393.
Written Opinion (PCT/ISA/237) mailed on Apr. 17, 2012, by the Japanese Patent Office as the International Searching Authority for International Application No. PCT/JP2012/050393.
(Continued)

*Primary Examiner* — Helal A Algahaim
*Assistant Examiner* — Mahmoud Ismail
(74) *Attorney, Agent, or Firm* — Buchanan Ingersoll & Rooney PC

(57) ABSTRACT

After latest door opening-side information is received from an operational management server on a ground after a train starts an operation, train-information managing apparatuses output the door opening-side information to display control apparatuses as guidance data, the display control apparatuses create video data indicating an opening side of doors for all stops at least between a next stop and a terminal station of the train using the door opening-side information, and displays perform display using the video data.

4 Claims, 4 Drawing Sheets

(51) Int. Cl.

| | |
|---|---|
| ***G06F 7/00*** | (2006.01) |
| ***G06F 17/00*** | (2006.01) |
| ***B61L 15/00*** | (2006.01) |
| ***B61L 27/00*** | (2006.01) |
| *G08B 1/08* | (2006.01) |
| *B61L 25/02* | (2006.01) |

(52) U.S. Cl.
CPC ..... *B61L15/0045* (2013.01); *B61L 25/02* (2013.01); *B61L 27/0022* (2013.01); *B61L 27/0027* (2013.01); *B61L 27/0077* (2013.01); *B61L 15/0027* (2013.01); *B61L 25/025* (2013.01)

(56) References Cited

FOREIGN PATENT DOCUMENTS

| | | | |
|---|---|---|---|
| JP | 11-5534 | A | 1/1999 |
| JP | 3067442 | U | 4/2000 |
| JP | 2002-127905 | A | 5/2002 |
| JP | 2010-34852 | A | 2/2010 |
| JP | 2010-260518 | A | 11/2010 |
| JP | 2011-46323 | A | 3/2011 |
| JP | 2011-105301 | A | 6/2011 |

OTHER PUBLICATIONS

Office Action of Japanese Patent Application No. 2012-525775 with English translation, mailed Jul. 17, 2012.

* cited by examiner (a) (b)

TRAIN GUIDANCE-DISPLAY SYSTEM AND TRAIN GUIDANCE-DISPLAY METHOD

FIELD

The present invention relates to a train guidance-display system and a train guidance-display method for displaying guidance on displays in the cars of a train.

BACKGROUND

In recent years, in trains, it has become general practice, for the convenience of passengers, to provide operational information and the like with a video on displays installed in the cars in addition to audio guidance from the train crew (see Patent Literature 1).

In a train, train information, such as operational information, is managed by train-information managing apparatuses. The train-information managing apparatuses are installed in respective cars of the train and connected so as to be capable of communicating with one another in order to share train information (see Patent Literature 1).

The train-information managing apparatuses hold train guidance data as part of the train information. The train guidance data is data set before the train starts its operation and is data including, for example, the destination, stops, estimated times of arrival at stations, estimated times of departure from stations, train type, and door opening-side information for the stops. In the train, it is possible to perform display guidance via the displays by using, the train guidance data.

In the display guidance in a train, the door opening side at a stop is sometimes displayed. Specifically, before arriving at the next station, for example, on the displays installed in the door lintel sections of the car, door opening and closing guidance is performed by displaying whether the doors below the displays are to open or the doors on the opposite side to open (see Patent Literature 1). Because the door opening-side information at a stop is displayed to passengers beforehand, the passengers can move to the door opening side before arriving at the station. Consequently, the passengers can smoothly get off the train. Therefore, it is possible to suppress occurrence of a departure delay. The door opening-side information is given in conjunction with platform information indicating which platform at a stop the train will enter.

In the door opening-side information included in the train guidance data, the door opening side is sometimes "undecided" depending on the stop. This is because the platform that the train enters is not decided beforehand depending on the stop. Concerning stations where the door opening side is not decided in advance and is undecided (a door opening-side undecided station), the door opening-side information included in the train guidance data is set as "undecided". Therefore, when the train departs from the station immediately preceding the door opening-side undecided station, the conductor manually inputs and sets, in the train-information managing apparatus, the latest door opening-side information for the next station obtained from outside the train. Consequently, the door opening side at the door opening-side undecided station is determined. Therefore, it is possible to display the door opening side on the displays.

CITATION LIST

Patent Literature

Patent Literature 1: Japanese Patent Application Laid-Open No. 2002-127905

SUMMARY

Technical Problem

In a conventional guidance display, because, in general, undecided information is included in the door opening-side information included in the train guidance data, only the door opening side at the next stop is displayed. Therefore, in a situation in which the train is full, in particular, in the case of a crowded train, it is not easy for the passengers intending to get off the train at the next stop to smoothly move to the door opening side in the limited time before arriving at the next stop after departing from the previous station even if the passengers are made aware of the door opening side at the next stop after departing from the previous station. As a result, it takes time to get off the train after arriving at the next stop. This causes delays in departure times.

The present invention has been devised in view of the above and it is an object of the present invention to provide a train guidance-display system and a train guidance-display method for enabling the door opening side to be displayed so that it assists passengers in smoothly getting off trains.

Solution to Problem

In order to solve the above problems and achieve the object, a train guidance-display system related to the present invention including: train-information managing apparatuses that are mounted on cars of a train, respectively, that are communicatively connected to each other via a trunk transmission line disposed among the cars, that share and manage train information concerning the train, that include first door opening-side information, which is information indicating an opening side of doors of the cars for all stops of the train set before an operation of the train and includes undecided information indicating that an opening side has been undecided for part of the stops, and that receive, from an operational management server on a ground, second door opening-side information, which is latest information indicating an opening side of doors of the cars for all the stops and does not include the undecided information, after the train starts an operation; display control apparatuses that are mounted on the cars of the train, respectively, that are connected to the train-information managing apparatuses of the cars, and that create video data using guidance data, which is data for display guidance and is output from the train-information managing apparatuses; and displays that are mounted on the cars of the train, respectively, that are connected to the display control apparatuses of the cars, and that perform display using the video data output from the display control apparatuses, wherein after the second door opening-side information is received from the operational management server after the train starts an operation, the train-information managing apparatuses output the second door opening-side information to the display control apparatuses as the guidance data, the display control apparatuses create video data indicating an opening side of doors for all stops at least between a next stop and a terminal station of the train using the second door opening-side information, and the displays perform display using the video data.

Advantageous Effects of Invention

According to the present invention, an effect is obtained where it is possible to display the door opening side so that it assists passengers in smoothly getting off trains.

DESCRIPTION OF EMBODIMENTS

Embodiments of a train guidance-display system and a train guidance-display method according to the present invention are explained in detail below with reference to the drawings. Note that the present invention is not limited by the embodiments.

First Embodiment

Figure 1:
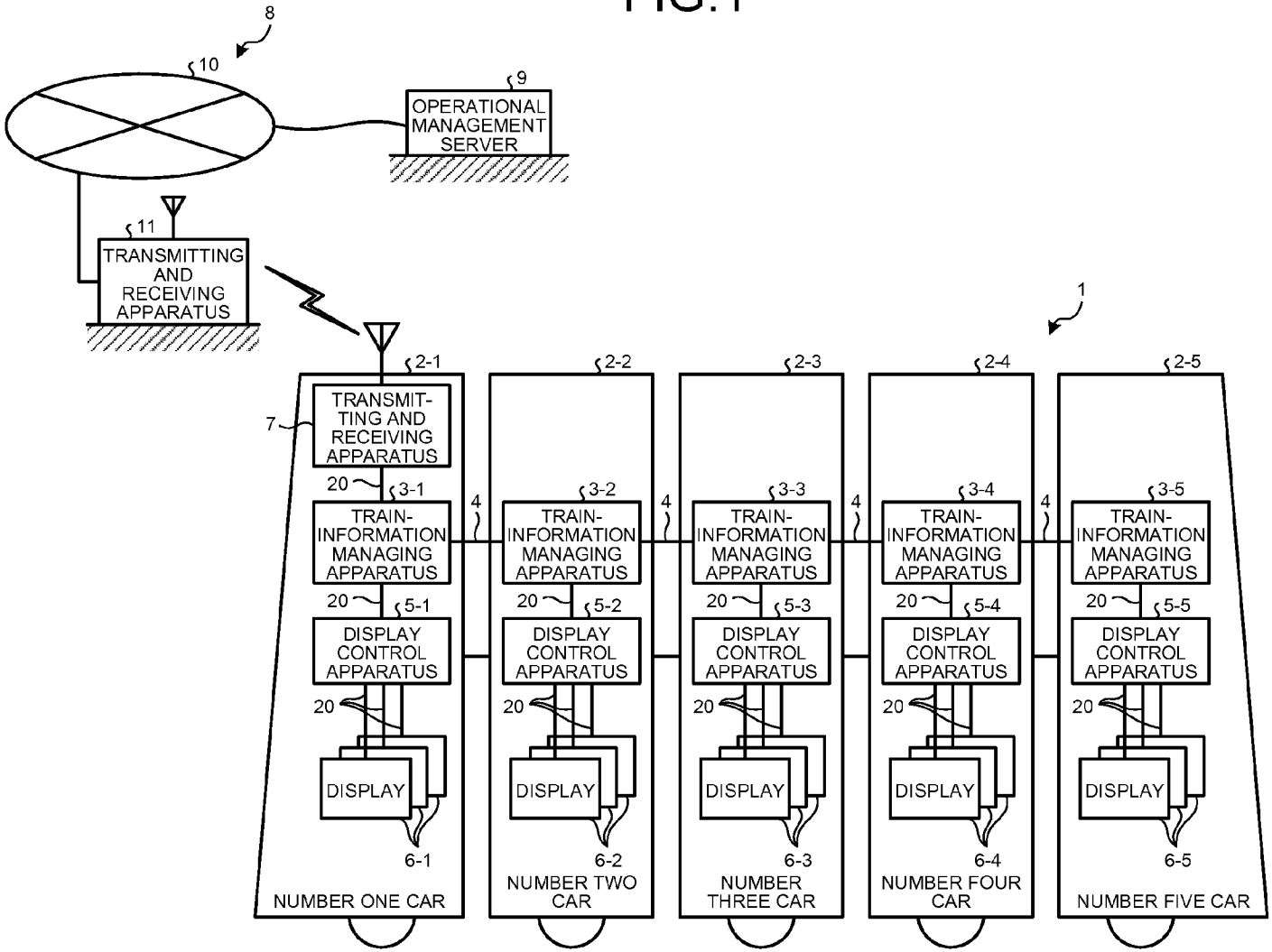
FIG. 1 is a diagram of the overall configuration of a train guidance-display system according to a first embodiment.

FIG. 1 is a diagram of the overall configuration of a train guidance-display system according to the present embodiment. The train guidance-display system according to the present embodiment is an on-board system 1 built on a train consist including, for example, five cars (the number one car to the number five car). The on-board system 1 is capable of exchanging information with a ground system 8 by radio communication. Note that the ground system 8 can be included in the present embodiment. The number of cars is not limited to the example shown in the figure. The on-board system 1 includes train-information managing apparatuses 3-1 to 3-5, display control apparatuses 5-1 to 5-5, displays 6-1 to 6-5, a transmitting and receiving apparatus 7, and the like. The ground system 8 includes an operational management server 9, a communication network 10, and a transmitting and receiving apparatus 11.

The configuration of the on-board system 1 is explained. On a head car 2-1 (the number one car), the train-information managing apparatus 3-1, the display control apparatus 5-1, the display 6-1, the transmitting and receiving apparatus 7, and the like are mounted. The train-information managing apparatus 3-1 is a so-called central apparatus and is connected to a master controller (not shown in the figure). Control information, such as acceleration and deceleration commands, is input to the train-information managing apparatus 3-1 from the master controller. The train-information managing apparatus 3-1 is connected to the display control apparatus 5-1, the display 6-1, and the transmitting and receiving apparatus 7 via an intra-car transmission line 20. Note that the train-information managing apparatus 3-1 is also connected to, via the intra-car transmission line 20, other apparatuses (not shown in the figure) mounted on the number one car.

The transmitting and receiving apparatus 7 is a radio communication apparatus and is capable of performing radio communication with the transmitting and receiving apparatus 11 of the ground system 8. The display control apparatus 5-1 is directly connected to the train-information managing apparatus 3-1 via the intra-car transmission line 20. The display control apparatus 5-1 creates video data on the basis of guidance data, which is data for display guidance, input from the train-information managing apparatus 3-1 and outputs the video data to the display 6-1. The display 6-1 is a display installed in the number one car. The display 6-1 performs display guidance using the video data input from the display control apparatus 5-1. The display 6-1 includes, for example, a plurality of displays, each of which is connected to the display control apparatus 5-1. The display 6-1 is installed, for example, in the lintel sections above the doors of the number one car.

Note that the train-information managing apparatus 3-5, the display control apparatus 5-5, and the display 6-5 mounted on a tail car 2-5 (the number five car) are the same as the train-information managing apparatus 3-1, the display control apparatus 5-1, and the display 6-1 mounted on the head car 2-1. Therefore, detailed explanation thereof is omitted. In FIG. 1, a transmitting and receiving apparatus is not provided in the tail car 2-5. However, as in the head car 2-1, a transmitting and receiving apparatus connected to the train-information managing apparatus 3-5 can be provided in the tail car 2-5.

In an intermediate car 2-2 (the number two car), the train-information managing apparatus 3-2, the display control apparatus 5-2, the display 6-2, and the like are mounted. The train-information managing apparatus 3-2 is a so-called terminal apparatus. The train-information managing apparatus 3-2 is connected to the display control apparatus 5-2 and the display 6-2 via the intra-car transmission line 20. Note that the train-information managing apparatus 3-2 is also connected, via the intra-car transmission line 20, to other apparatuses (not shown in the figure) mounted on the number two car.

The display control apparatus 5-2 is directly connected to the train-information managing apparatus 3-2 via the intra-car transmission line 20. The display control apparatus 5-2 creates video data on the basis of guidance data input from the train-information managing apparatus 3-2 and outputs the video data to the display 6-2. The display 6-2 is a display installed in the number two car. The display 6-2 performs display guidance using the video data input from the display control apparatus 5-2. The display 6-2 includes, for example, a plurality of displays, each of which is connected to the display control apparatus 5-2. The display 6-2 is installed, for example, in the lintel sections above the doors of the number two car.

Note that the train-information managing apparatuses 3-3 and 3-4, the display control apparatuses 5-3 and 5-4, and the displays 6-3 and 6-4 respectively mounted on intermediate cars 2-3 and 2-4 (the number three car and the number four car) are the same as the train-information managing apparatus 3-2, the display control apparatus 5-2, and the display 6-2 of the intermediate car 2-2. Therefore, detailed explanation thereof is omitted.

The train-information managing apparatuses 3-1 to 3-5 are communicatively connected to each other by a trunk transmission line (an inter-car transmission line) 4 disposed among the cars. The train-information managing apparatuses 3-1 to 3-5 share and manage train information with one another. Details of an example of the train information are described in, for example, Patent Literature 1.

The configuration of the ground system 8 is explained. The ground system 8 includes the operational management server 9. The operational management server 9 manages operational management information concerning on-rail trains on a rail managed by the operational management server 9. The operational management server 9 is connected to the communication network 10, which is an exclusive existing railroad line network. The operational management server 9 can exchange data with the transmitting and receiving apparatus 7 of the on-board system 1 via the transmitting and receiving apparatus 11. For example, a plurality of the transmitting and receiving apparatuses 11 are provided along a railroad.

Figure 2:
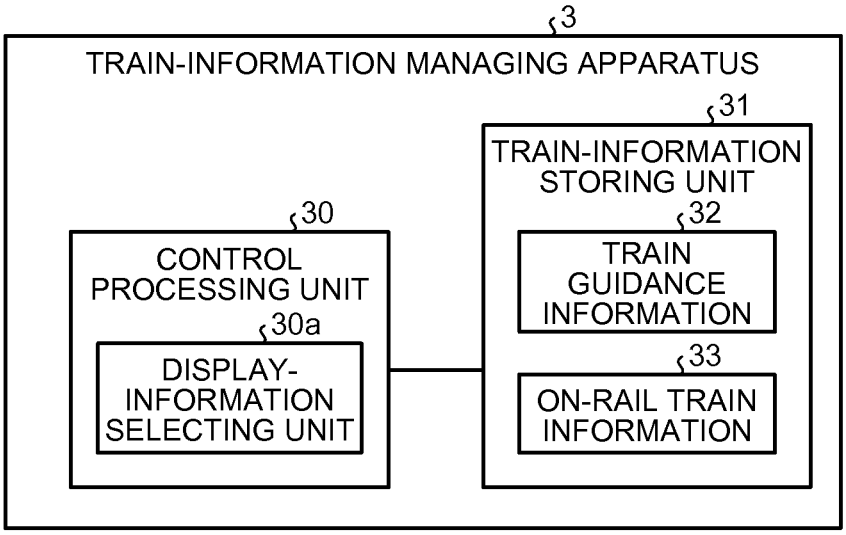
FIG. 2 is a diagram of the internal configuration of a train-information managing apparatus.
Figure 3:
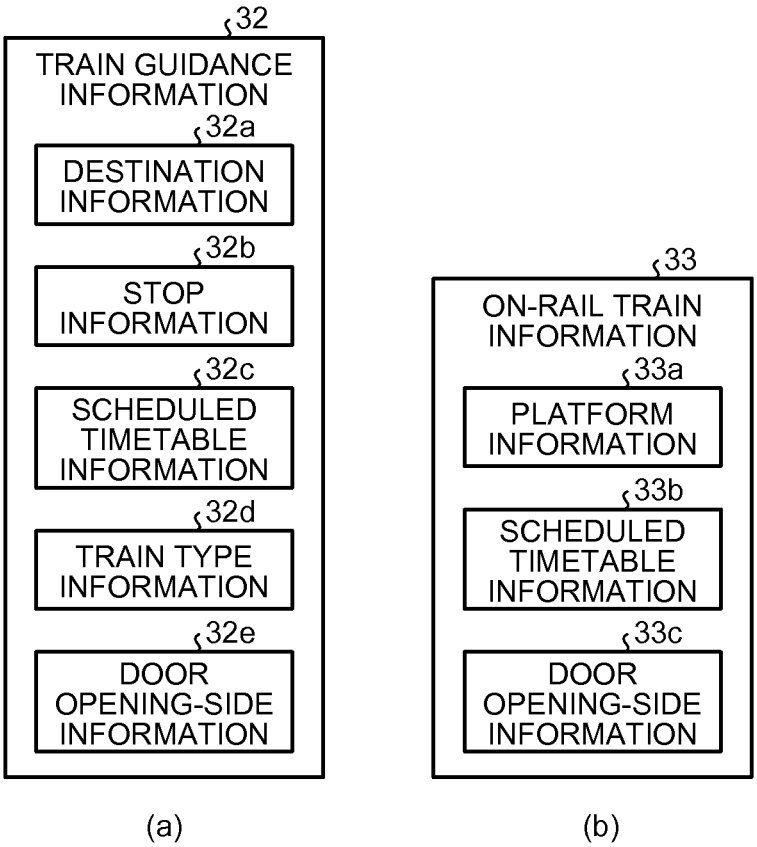
FIG. 3 is a diagram of an example of train guidance information and on-rail train information.

The internal configuration of the train-information managing apparatuses 3-1 to 3-5 is explained. FIG. 2 is a diagram of the internal configuration of a train-information managing apparatus 3. FIG. 3 is a diagram of an example of train guidance information and on-rail train information. Note that, in the following explanation, the train-information managing apparatuses 3-1 to 3-5 are collectively referred to as the train-information managing apparatus 3. The display control apparatuses 5-1 to 5-5 are collectively referred to as a display control apparatus 5. The displays 6-1 to 6-5 are collectively referred to as a display 6.

As shown in FIG. 2, the train-information managing apparatus 3 includes a control processing unit 30 and a train-information storing unit 31 connected to the control processing unit 30. The control processing unit 30 includes a display-information selecting unit 30*a* as a functional component thereof. The control processing unit 30 includes hardware, such as a CPU, and operates according to a control program for specifying a control operation thereof. Note that the control processing unit 30 is connected to the trunk transmission line 4 and the intra-car transmission line 20 via a transmitting and receiving unit (not shown in the figure).

The display-information selecting unit 30*a* selects guidance information (guidance data) to be displayed on the display 6 out of train information stored in the train-information storing unit 31 and outputs the selected guidance information to the display control apparatus 5.

The train-information storing unit 31 has the train information stored therein. The train information includes, for example, general information concerning an operation of the train, and control information and state information on car-mounted apparatuses. In the example shown in the figure, only train guidance information (train guidance data) 32 and on-rail train information (on-rail train data) 33 among these pieces of information are clearly shown.

In FIG. 3(*a*), an example of the train guidance information 32 is shown. The train guidance information 32 includes, for example, destination information 32*a*, stop information 32*b*, scheduled timetable information 32*c*, train type information 32*d*, and door opening-side information 32*e*. The train guidance information 32 is data set before the operation of the train. In other words, the train guidance information 32 is set before the train departs from the starting station.

The destination information 32*a* is information representing the destination of the train. The stop information 32*b* is information representing stop names of the train. The scheduled timetable information 32*c* is timetable information for giving, for example, estimated times of arrival at stations and estimated times of departure from stations for the stops. The train type information 32*d* is information representing the type of the train such as local, rapid, express, or superexpress. The door opening-side information 32*e* (first door opening-side information) is information representing, for each of the stops, the side on which the doors of the train open. The door opening-side information 32*e* is, for example, information specifically indicating the doors on which of the right side and the left side with respect to the running direction of the train open.

However, the door opening side is sometimes undecided depending on the stop. In such a case, the door opening-side information 32*e* is information indicating that the door opening side is undecided. As explained above, the train guidance information 32 is information set in advance before the train starts its operations. When the train guidance information 32 is set, it is sometimes not decided which platform the train enters depending on the stop. In other words, concerning the stop at which the platform that the train enters is likely to be changed because of, for example, the operation of the train on the day, platform information is not decided beforehand. Concerning such a stop, the door opening side is also "undecided". In the present embodiment, the door opening-side information 32*e* includes undecided information concerning part of the stops.

In FIG. 3(*b*), an example of the on-rail train information 33 is shown. The on-rail train information 33 includes, for example, platform information 33*a*, scheduled timetable information 33*b*, and door opening-side information 33*c*. The on-rail train information 33 is data transmitted from the operational management server 9 to the train-information managing apparatus 3. The on-rail train information 33 is transmitted from the operational management server 9 to the train-information managing apparatus 3, for example, periodically while a train is present on a railroad. Therefore, when the operation is started, the on-rail train information 33 is not included in the train-information storing unit 31. When the control processing unit 30 receives the latest on-rail train information 33 from the operational management server 9, the control processing unit 30 stores the latest on-rail train information 33 in the train-information storing unit 31 or overwrites the on-rail train information 33 in the train-information storing unit 31 with the latest on-rail train information 33. Note that the on-rail train information 33 can be transmitted from the operational management server 9 to the train-information managing apparatus 3 only when the content of the on-rail train information 33 is changed.

The platform information 33*a* is information indicating in which platform the train enters at each stop. The platform information 33*a* is the latest information transmitted from the operational management server 9 and is information decided for all the stops. In other words, undecided information is not included in the platform information 33*a*.

The scheduled timetable information 33*b* gives, for example, the estimated time of arrival at a station and the estimated time of departure from a station for each stop. The scheduled timetable information 33*b* is the latest information transmitted from the operational management server 9. The scheduled timetable information 33*b* sometimes coincides with the scheduled timetable information 32*c*. However, the scheduled timetable information 33*b* is sometimes changed from the scheduled timetable information 32*c* according to the operational state or the like on the day. In other words, the scheduled timetable information 33*b* gives the latest scheduled timetable information.

The door opening-side information 33*c* (second door opening-side information) is information representing, for each stop, the side on which the doors of the train open. Like the door opening-side information 32*e*, the door opening-side information 33*c* is, for example, information specifically indicating the doors on which of the right side and the left side with respect to the running direction of the train open. However, undecided information is not included in the door opening-side information 33*c*. In other words, the door opening-side information 33*c* is the latest information transmitted from the operational management server 9 and is information decided for all the stops in conjunction with the platform information 33*a*.

Operations in the present embodiment are explained. First, processing of the train-information managing apparatus 3 for acquiring the latest on-rail train information 33 from the operational management server 9 is explained.

After the operation of the train is started, the train-information managing apparatus 3-1 transmits train identification information concerning the own train to the ground system 8. The train identification information is information including, for example, the departure station or the arrival station nearest to the train, destination, train type, and train number and includes information for enabling the train to be distinguished from other trains. The train-information managing apparatus 3-1 transmits the train identification information to the ground system 8 via the transmitting and receiving apparatus 7, for example, periodically during the operation of the train.

The train identification information transmitted from the train-information managing apparatus 3-1 to the ground system 8 by radio is received by the transmitting and receiving apparatus 11 of the ground system 8 and thereafter transmitted to the operational management server 9 through the communication network 10. After receiving the train identification information, the operational management server 9 performs, on the basis of the train identification information, a search to determine whether the operational management server 9 includes operational management information on the train corresponding to the train identification information. As a result of the search, when the operational management server 9 includes the operational management information concerning the train, the operational management server 9 creates the on-rail train information 33 on the basis of the operational management information. In other words, the operational management information includes a larger number of pieces of information than the on-rail train information 33. The operational management server 9 transmits the created on-rail train information 33 to the train-information managing apparatus 3-1, which is the transmission source of the train identification information. In other words, the on-rail train information 33 is transmitted from the operational management server 9 to the transmitting and receiving apparatus 11 through the communication network 10 and further transmitted to the on-board system 1 by radio by the transmitting and receiving apparatus 11. Note that, as a result of the search, when the operational management server 9 does not include the operation management information corresponding to the train, the operational management server 9 returns, to the train-information managing apparatus 3-1, "no train information" indicating that the corresponding train is not found. Usually, the operational management server 9 includes operational information on the on-rail train. Therefore, this is an exceptional case.

When the train-information managing apparatus 3-1 receives the on-rail train information 33 from the operational management server 9, the train-information managing apparatus 3-1 stores the received on-rail train information 33 in the train-information storing unit 31 thereof and transmits the on-rail train information 33 to the train-information managing apparatuses 3-2 to 3-5. Each of the train-information managing apparatuses 3-2 to 3-5 stores the received on-rail train information 33 in the train-information storing unit 31 thereof. On the other hand, when the train-information managing apparatus 3-1 receives "no train information" from the operational management server 9, the train-information managing apparatus 3-1 does not update the stored content of the train-information storing unit 31 thereof and does not perform transmission of information to the train-information managing apparatuses 3-2 to 3-5.

Processing for selecting the door opening-side information in the train-information managing apparatus 3 is explained. First, the display-information selecting unit 30*a* checks whether the on-rail train information 33 is stored in the train-information storing unit 31. When the on-rail train information 33 is stored in the train-information storing unit 31, the display-information selecting unit 30*a* selects the door opening-side information 33*c* included in the on-rail train information 33 and outputs the door opening-side information 33*c* to the display control apparatus 5. Note that, in this case, other information necessary for displaying guidance is also selected and output. On the other hand, when the on-rail train information 33 is not stored in the train-information storing unit 31 (i.e., the "no train information" is received from the operational management server 9), the display-information selecting unit 30*a* selects the door opening-side information 32*e* included in the train guidance information 32 and outputs the door opening-side information 32*e* to the display control apparatus 5. Note that, in this case, other information necessary for displaying guidance is also selected and output.

When the display control apparatus 5 receives the guidance data including the door opening-side information 33*c* from the train-information managing apparatus 3, the display control apparatus 5 creates video data on the basis of the guidance data and transmits the created video data to the display 6. The display 6 displays guidance on the basis of the video data received from the display control apparatus 5.

Figure 4:
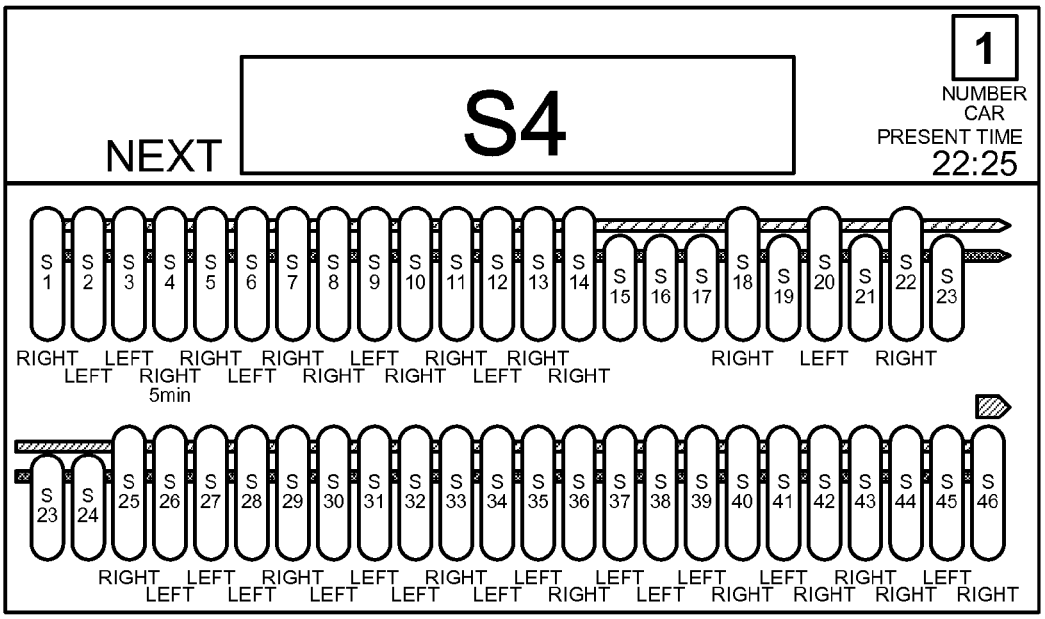
FIG. 4 is a diagram of an example of display guidance created on the basis of door opening-side information 33*c*.

FIG. 4 is a diagram of an example of display guidance created on the basis of the door opening-side information 33*c*. In FIG. 4, "S1" to "S46" represent station names on a route. The train is running toward "S4" after departing from "S3". Information indicating that the next stop is "S4" is displayed in the upper part of the screen. "Left" or "right" is displayed under the stop to specifically indicate the door opening side. In other words, "left" indicates that the doors on the left side with respect to the running direction of the train open. "Right" indicates that the doors on the right side open. Because "S15" to "S17", "S19", "S21", and "S23" to "S24" are non-stop stations, the door opening side is not shown. Note that, in FIG. 4, the door opening-side information is displayed for all the stops. However, the door opening-side information for all the stops from the next stop of the train can be displayed. In this way, the door opening-side information for all the stops from the next stop is displayed on the same screen, for example, simultaneously before the train arrives at the next stop.

On the other hand, when the display control apparatus 5 receives the guidance data including the door opening-side information 32*e* from the train-information managing apparatus 3, the display control apparatus 5 creates video data on the basis of the guidance data and transmits the created video data to the display 6. The display 6 displays guidance on the basis of the video data received from the display control apparatus 5.

Figure 5:
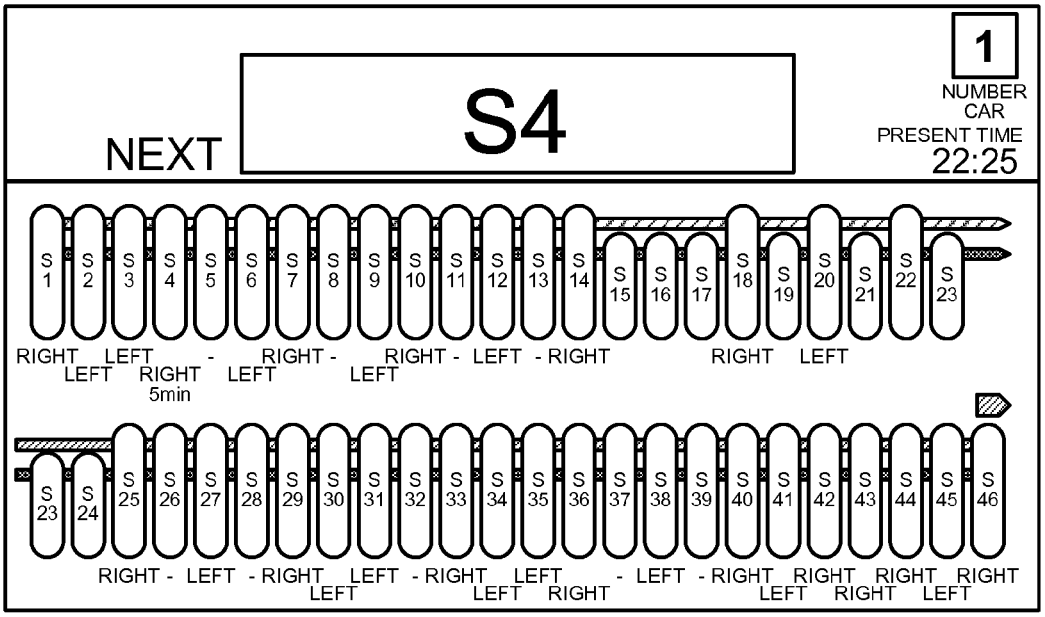
FIG. 5 is a diagram of an example of display guidance created on the basis of door opening-side information 32*e*.

FIG. 5 is a diagram of an example of display guidance created on the basis of the door opening-side information 32*e*. In FIG. 5, unlike FIG. 4, "—" is displayed concerning the stops "S5", "S8", "S11", "S13", "S22", "S26", "S28", "S32", "S37", and "S39", which are stops for which the door opening-side information 32*e* is "undecided", to indicate that the door opening side is "undecided".

In the present embodiment, the train-information managing apparatus 3 periodically receives the latest on-rail train information 33 including the door opening-side information 33*c* from the operational management server 9. Therefore, the display control apparatus 5 can create video data using the door opening-side information 33*c* not including the undecided information and can display, on the display 6 in the car, the door opening side at all the stops at least between the next stop and the terminal station. Consequently, passengers can move to the door opening side in good time a few stations before approaching the station where the passengers are going to get off the train. Therefore, the passengers can smoothly get off the train and thus it is possible to reduce delays in departure times. In particular, in a crowded train, the effect of the present embodiment is significant. Further, because the passengers can smoothly get off the train, this leads to passengers having less stress when they get off the train. In the present embodiment, for example, an input of the door opening-side information by the conductor is unnecessary.

In contrast, conventionally, guidance display of the door opening side is performed on the basis of the door opening-side information 32*e* included in the train guidance information 32. Concerning the door opening-side undecided stations, the conductor sequentially manually inputs and sets the door opening-side information to the train-information managing apparatus 3 after departing from the previous station. Therefore, the passengers cannot obtain beforehand the door opening-side information for the stops after the next stop. Therefore, in particular, in the case of a crowded train, it is not easy for the passengers intending to get off the train at the next stop to smoothly move to the door opening side within the time before arriving at the next stop even if the passengers are made aware of the door opening side at the next stop after departing from the previous station. As a result, it takes time to get off the train after arriving at the next stop. This causes delays in departure times.

Second Embodiment

In the present embodiment, an example is explained in which processing for selecting the door opening-side information in the train-information managing apparatus 3 is performed according to the delay time of the train. Note that the configuration in the present embodiment is the same as the configuration in the first embodiment explained with reference to FIG. 1 to FIG. 5.

Figure 6:
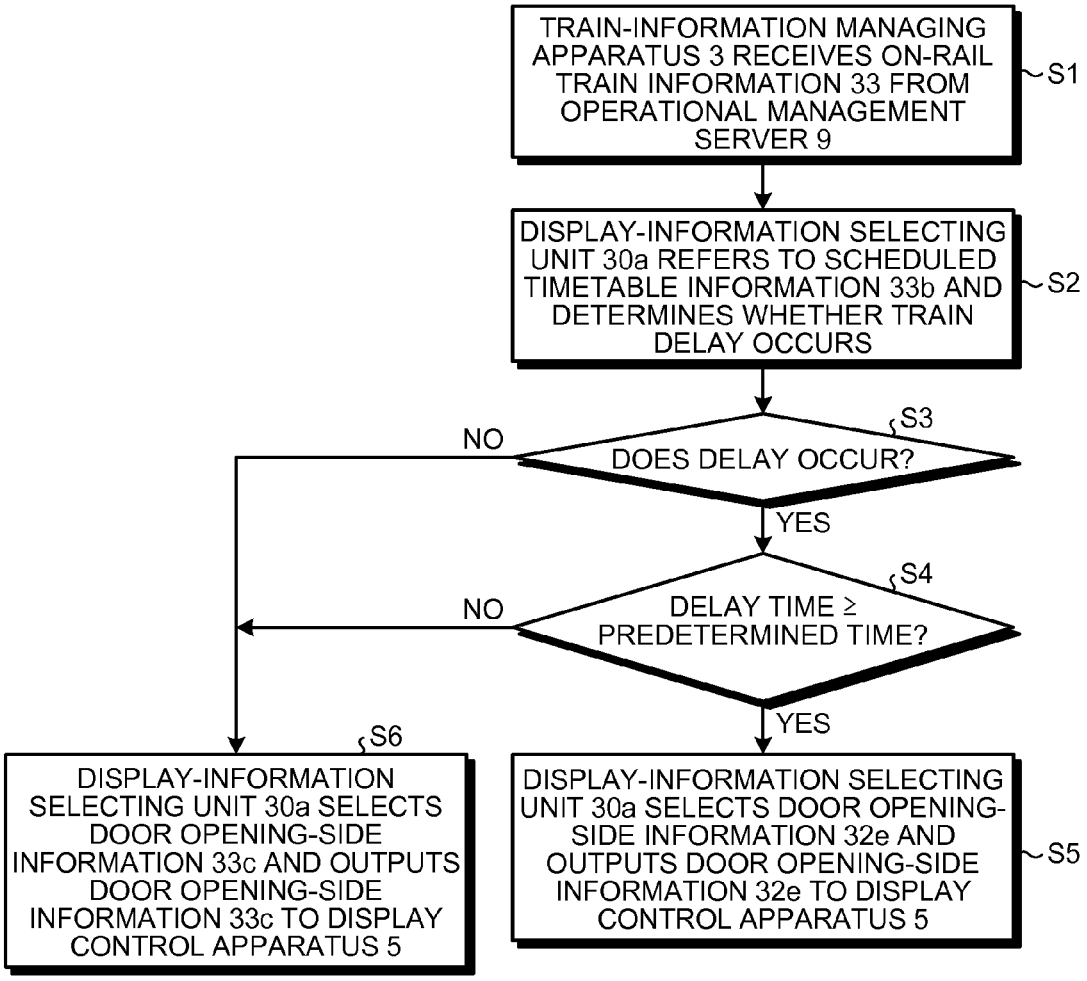
FIG. 6 is a flowchart illustrating an operation in a second embodiment.

FIG. 6 is a flowchart illustrating an operation in the present embodiment. First, the train-information managing apparatus 3 receives the latest on-rail train information 33 from the operational management server 9 (S1) and stores the on-rail train information 33 in the train-information storing unit 31.

Subsequently, the display-information selecting unit 30*a* refers to the scheduled timetable information 33*b* included in the on-rail train information 33 and determines whether a train delay occurs (S2). Specifically, when a train arrives at a stop, the display-information selecting unit 30*a* compares the estimated time of arrival at the station included in the scheduled timetable information 33*b* and the actual arrival time, determines whether a delay occurs, and, when a delay occurs, calculates the delay time. Note that, when the train departs from the stop, the display-information selecting unit 30*a* can compare the estimated time of departure from the station included in the scheduled timetable information 33*b* and the actual departure time, determine whether a delay occurs, and, when a delay occurs, calculate the delay time. When the estimated time of passage of the train at a predetermined point between stations is included in the scheduled timetable information 33*b*, the display-information selecting unit 30*a* can determine whether a delay occurs by referring to train running position information (e.g., kilometrage information on the distance from the starting station) serving as train information stored by the train-information managing apparatus 3 and comparing the time of passage at the predetermined point and the expected time of passage. The delay time is an actual time of delay given as a difference between the station arrival time or the station departure time included in the scheduled timetable information 33*b* and the present time.

When a delay occurs (Yes at S3), if the delay time is equal to or longer than a predetermined time (Yes at S4), although the display-information selecting unit 30*a* obtains the door opening-side information 33*c*, the display-information selecting unit 30*a* does not select the door opening-side information 33*c* but selects the door opening-side information 32*e*, and outputs the door opening-side information 32*e* to the display control apparatus 5 (S5). The predetermined time is time of, for example, several minutes to several tens of minutes set in advance. Consequently, the display control apparatus 5 creates video data using guidance data including the door opening-side information 32*e*.

On the other hand, when a delay does not occur (No at S3) or, even if a delay occurs, when the delay time is shorter than the predetermined time (No at S4), the display-information selecting unit 30*a* selects the door opening-side information 33*c* and outputs the door opening-side information 33*c* to the display control apparatus 5 (S6). Consequently, the display control apparatus 5 creates video data using guidance data including the door opening-side information 33*c*.

The reason for selecting the door opening-side information according to the delay time in this way is as explained below. When a train delay occurs, at the door opening-side undecided station, the platform that the train enters is likely to be suddenly changed. Therefore, when a train delay equal to or longer than the predetermined time occurs, assuming that the platform that the train enters at the door opening-side undecided station is likely to be adjusted, display is switched to undecided display in advance for all the door opening-side undecided stations from the next stop. This is because it is considered desirable to display the door opening-side information as undecided rather than providing the passengers with indefinite door opening-side information.

In FIG. 4 and FIG. 5, a delay time "5 min" is displayed under "S4" together with the display of the door opening side. The delay time is calculated by the display-information selecting unit 30*a* as an actual time of delay as explained above.

The display-information selecting unit 30*a* outputs the door opening-side information 33*c* or the door opening-side information 33*c* and the delay time to the display control apparatus 5. The display control apparatus 5 creates video data on the basis of the door opening-side information 33*c* or the door opening-side information 33*c* and the delay time. If the predetermined time is, for example, 8 minutes, the display 6 displays guidance as shown in FIG. 4. If the predetermined time is, for example, 5 minutes, the display 6 displays guidance as shown in FIG. 5 even if the on-rail train information 33 is stored in the train-information storing unit 31. Because the delay time is included in the display guidance, it also has an effect of reducing the stress that the passengers feel.

Note that other operations and effects of the present embodiment are the same as those in the first embodiment.

INDUSTRIAL APPLICABILITY

As explained above, the present invention is useful as a train guidance-display system and a train guidance-display method for displaying guidance on displays in the cars of a train.

REFERENCE SIGNS LIST

1 On-board system
2-1 Head car
2-2 to 2-4 Intermediate car
2-5 Tail car
3, 3-1 to 3-5 Train-information managing apparatus
4 Trunk transmission line
5, 5-1 to 5-5 Display control apparatus
6, 6-1 to 6-5 Display
7, 11 Transmitting and receiving apparatus
8 Ground system
9 Operational management server
10 Communication network

20 Intra-car transmission line
30 Control processing unit
30*a* Display-information selecting unit
31 Train-information storing unit
32 Train guidance information
32*a* Destination information
32*b* Stop information
32*c* Scheduled timetable information
32*d* Train type information
32*e* Door opening-side information
33 On-rail train information
33*a* Platform information
33*b* Scheduled timetable information
33*c* Door opening-side information

The invention claimed is:

1. A train guidance-display system comprising:

train-information managing apparatuses that are mounted on cars of a train, respectively, that are communicatively connected to each other via a trunk transmission line disposed among the cars, that share and manage train information concerning the train, that include first door opening-side information, which is information indicating an opening side of doors of the cars for all stops of the train set before an operation of the train and includes undecided information indicating that an opening side has been undecided for part of the stops, and that receive, from an operational management server on a ground, second door opening-side information, which is latest information indicating an opening side of doors of the cars for all the stops and does not include the undecided information, after the train starts an operation;

wherein the undecided information is based on absence of information regarding which platform the train enters depending on the stop;

display control apparatuses that are mounted on the cars of the train, respectively, that are connected to the train-information managing apparatuses of the cars, and that create video data using guidance data, which is data for display guidance and is output from the train-information managing apparatuses; and displays that are mounted on the cars of the train, respectively, that are connected to the display control apparatuses of the cars, and that perform display using the video data output from the display control apparatuses, wherein after the second door opening-side information and latest scheduled timetable information on the train are received from the operational management server after the train starts an operation, the train-information managing apparatuses determine whether a delay of the train occurs on a basis of the scheduled timetable information, and, as a result of determination, when a delay does not occur or, even if a delay occurs, when a delay time of the delay is shorter than a predetermined time, the train-information managing apparatuses output the second door opening-side information to the display control apparatuses as the guidance data, and, when a delay occurs and a delay time of the delay is equal to or longer than the predetermined time, the train-information managing apparatuses output the first door opening-side information to the display control apparatuses as the guidance data, when the second door opening-side information is output from the train-information managing apparatuses, the display control apparatuses create video data indicating an opening side of doors for all stops at least between a next stop and a terminal station of the train using the second door opening-side information, when the first door opening-side information is output from the train-information managing apparatuses, the display control apparatuses create video data indicating an opening side of doors or indicating that an opening side has been undecided for all stops at least between the next stop and the terminal station of the train using the first door opening-side information, and the displays perform display using the video data.

2. The train guidance-display system according to claim 1, wherein the train-information managing apparatuses periodically receive the second door opening-side information from the operational management server.

3. The train guidance-display system according to claim 1, wherein the displays display, from a time before the train arrives at the next stop, video data indicating an opening side of doors for all stops at least between the next stop and the terminal station of the train.

4. A train guidance-display method for a train guidance-display system including: train-information managing apparatuses that are mounted on cars of a train, respectively, that are communicatively connected to each other via a trunk transmission line disposed among the cars, that share and manage train information concerning the train, and that include first door opening-side information, which is information indicating an opening side of doors of the cars for all stops of the train set before an operation of the train and includes undecided information indicating that an opening side has been undecided for part of the stops; display control apparatuses that are mounted on the cars of the train, respectively, that are connected to the train-information managing apparatuses of the cars, and that create video data using guidance data, which is data for display guidance and is output from the train-information managing apparatuses; and displays that are mounted on the cars of the train, respectively, that are connected to the display control apparatuses of the cars, and that perform display using the video data output from the display control apparatuses, the train guidance-display method comprising:

a step of the train-information managing apparatuses receiving second door opening-side information, which is latest information indicating an opening side of doors of the cars for all the stops and does not include the undecided information, and latest scheduled timetable information on the train from an operational management server on a ground after the train starts an operation;

a step of the train-information managing apparatuses determining whether a delay of the train occurs on a basis of the scheduled timetable information, and, as a result of determination, when a delay does not occur or, even if a delay occurs, when a delay time of the delay is shorter than a predetermined time, outputting the second door opening-side information to the display control apparatuses as the guidance data, and, when a delay occurs and a delay time of the delay is equal to or longer than the predetermined time, outputting the first door opening-side information to the display control apparatuses as the guidance data;

a step of the display control apparatuses creating video data indicating an opening side of doors for all stops at least between a next stop and a terminal station of the train using the second door opening-side information when the second door opening-side information is output from the train-information managing apparatuses and creating video data indicating an opening side of doors or indicating that an opening side has been undecided for all stops at least between the next stop and the terminal station of the train using the first door opening-side information when the first door opening-side information is output from the train-information managing apparatuses; and a step of the displays performing display using the video data.

* * * * *